US005761590A

United States Patent [19]

Sato

[11] Patent Number: 5,761,590

[45] Date of Patent: Jun. 2, 1998

[54] DEVELOPING APPARATUS HAVING A BIAS VOLTAGE SUPPLIED TO A CONDUCTIVE BLADE

[75] Inventor: Koichiro Sato, Tokyo, Japan

[73] Assignee: Kabushiki Kaisha TEC, Shizuoka, Japan

[21] Appl. No.: 602,318

[22] Filed: Feb. 16, 1996

[30] Foreign Application Priority Data

Feb. 20, 1995 [JP] Japan ..... 7-030338

[51] Int. Cl.[6] ..... G03G 15/08

[52] U.S. Cl. ..... 399/285; 399/284

[58] Field of Search ..... 355/245, 246, 355/259; 118/651; 399/270, 274, 284, 285

[56] References Cited

U.S. PATENT DOCUMENTS

| | | | |
|---|---|---|---|
| 5,017,967 | 5/1991 | Koga | 355/259 X |
| 5,057,871 | 10/1991 | Hirose et al. | 355/259 |
| 5,183,964 | 2/1993 | Stelter et al. | 355/259 X |
| 5,314,774 | 5/1994 | Camis | 355/245 X |
| 5,365,318 | 11/1994 | Hiraoka et al. | 355/246 |
| 5,519,472 | 5/1996 | Ojima et al. | 355/246 |

FOREIGN PATENT DOCUMENTS 0 482 867 A2 4/1992 European Pat. Off. .

*Primary Examiner*—Arthur T. Grimley
*Assistant Examiner*—Sophia S. Chen
*Attorney, Agent, or Firm*—Frishauf, Holtz, Goodman, Langer & Chick

[57] ABSTRACT

A developing apparatus includes a developing roller which rotates along with the photosensitive drum on which an electrostatic latent image is formed, and feeding toner to be adhered to the electrostatic latent image formed on the photosensitive drum, a conductive blade for uniformly limiting the thickness of the toner put on the developing roller, and a first high-voltage generator for generating a development bias voltage of −200 V which is supplied to the developing roller and biases the potential of the toner. Particularly, the developing apparatus further includes a second high-voltage generator for generating a blade voltage of −300 V which is supplied to the conductive blade and electrostatically charging the toner to compensate for a shortage of the electrostatic charge obtained in the toner by friction on the developing roller.

6 Claims, 3 Drawing Sheets

DEVELOPING APPARATUS HAVING A BIAS VOLTAGE SUPPLIED TO A CONDUCTIVE BLADE

BACKGROUND OF THE INVENTION

1. FIELD OF THE INVENTION

The present invention relates to a developing apparatus for developing an electrostatic latent image formed on an image carrier by an electrophotographic process, and more particularly to a developing apparatus having a roller which rotates along with the image carrier to feed a developer.

2. DESCRIPTION OF THE RELATED ART

In a typical laser printer, a photosensitive drum is used as the image carrier. The laser printer performs an electrophotographic process of uniformly charging the surface of the photosensitive drum which rotates in one direction, selectively exposing the charged surface of the drum with a laser beam to form an electrostatic latent image, developing the latent image using toner serving as the developer, and transferring the developed image from the photosensitive drum onto paper.

This laser printer includes a developing section which feeds toner to the photosensitive drum in order to develop the electrostatic latent image formed thereon. The developing section has a hopper for storing toner, a developing roller which rotates along with the photosensitive drum to feed the toner stored in the hopper to the photosensitive drum, a spring blade for uniformly limiting the thickness of the toner on the developing roller, and a high-voltage generator for generating the development bias voltage to be supplied to the developing roller to bias the potential of the toner. Toner is put on the developing roller in the hopper, the developing roller carries the toner to the outside of the hopper via the spring blade. The toner is electrostatically charged by friction thereof which occurs upon rotation of the developing roller, and adhered to the electrostatic latent image on the photosensitive drum by electrostatic attraction.

It should be noted that the developing roller rotates usually at a peripheral or circumferential speed of nearly twice that of the photosensitive drum. If the peripheral speed of the developing roller is substantially equal to that of the photosensitive drum, a sufficient amount of toner is not carried by the developing roller due to a shortage of the peripheral speed, and a sufficient amount of charge is not obtained in the toner due to a shortage of frictional force. As a result, the concentration of a toner image, which is made of toner adhered to the latent image on the photosensitive drum, is lowered. In order to maintain the quality of the toner image, the above-mentioned ratio is required between the peripheral speeds of the developing roller and the photosensitive drum.

However, such a peripheral speed ratio entails the following problems. The first problem is that the service life of the drum is short since the wear rate of the photosensitive drum is relatively high. The second problem is that toner tends to form a film which is hard to remove from the developing roller. The third problem is that the developing roller requires a larger rotational torque, which causes an increase in noise.

SUMMARY OF THE INVENTION

An object of the present invention is to provide a developing apparatus in which the peripheral speed of the developing roller can be set closer to the peripheral speed of the image carrier without deteriorating the development properties.

This object can be attained by a developing apparatus which comprises: a developing roller for rotating along with an image carrier on which an electrostatic latent image is formed, and feeding a developer to be adhered to the electrostatic latent image formed on the image carrier; a conductive blade for uniformly limiting the thickness of the developer on the developing roller; a first high-voltage generator for generating a development bias voltage which is supplied to the developing roller and biases a potential of the developer; and a second high-voltage generator for generating a blade voltage which is supplied to the conductive blade and electrostatically charges the developer to compensate for a shortage of an electrostatic charge obtained in the developer by friction on the developing roller.

In the developing apparatus, if the peripheral speed of the developing roller is set closer to that of the image carrier, this decreases the frictional force of the developer while solving the above-mentioned problems, namely, the wear of the image carrier, the difficulty in removing the developer film from the developing roller, and a large rotational torque of the developing roller causing an increase in noise. However, since the blade voltage is supplied from the second high-voltage generator, the toner is electrostatically charged to compensate for a shortage of an electrostatic charge obtained by friction on the developing roller. Therefore, the amount of charge in the developer, with which an electrostatic latent image can be developed into a developer image having a sufficient concentration, can be maintained. Consequently, the peripheral speed of the developing roller can be set closer to that of the image carrier without deteriorating the development properties. Moreover, when there is a leak current which flows between the conductive blade and the developing roller due to a difference between the blade voltage and the development bias voltage, a current limiting element is provided to limit the leak current. This limitation of a leak current effectively prevents the deterioration of the image quality of the developer image and the malfunction of the apparatus from occurring due to a noise caused by the leak current.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE EMBODIMENT

A laser printer according to an embodiment of the present invention will now be described with reference to accompanying drawings.

Figure 1:
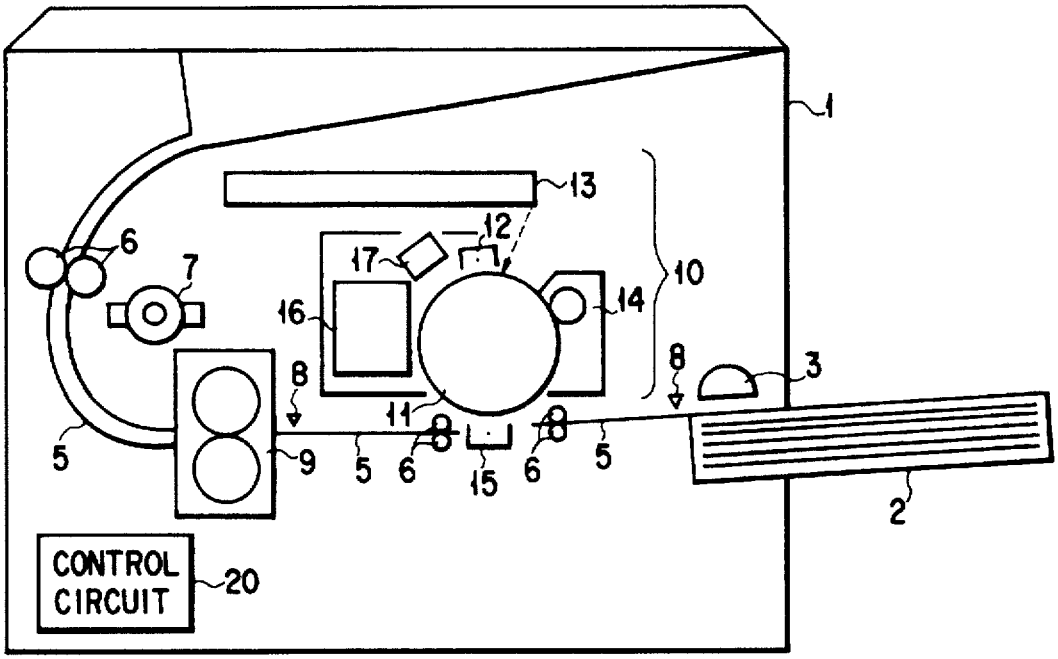
FIG. 1 is a sectional view showing an internal structure of a laser printer according to an embodiment of the present invention.

FIG. 1 schematically shows the internal structure of the laser printer. The laser printer includes a cabinet 1, a paper supply cassette 2, a pick-up roller 3, a conveying path 5, pairs of convey rollers 6, a motor 7, a sensor group 8, a fixing unit 9, an electrophotographic process unit 10, and a control circuit 20. The paper supply cassette 2 is detachably mounted to the cabinet 1, and contains a stack of paper. The pick-up roller 3 takes out the paper one by one from the paper supply cassette 2 to the conveying path 5. The pairs of convey rollers 6 are arranged to convey the paper along the conveying path 5. The motor 7 is coupled with the pick-up roller 3, the convey roller 6, and other mechanisms so that these components are operated by a driving force from the motor 7. The sensor group 8 serves to sense a variety of states of the laser printer, including the current position of the paper being conveyed. The electrophotographic process unit 10 prints an image obtained by the electrophotographic process on the paper conveyed along the conveying path 5. The fixing unit 9 fixes the image printed on the paper by the electrophotographic process unit 10. The control circuit 20 controls the printing operation of the laser printer.

The electrophotographic process unit 10 includes a photosensitive drum 11 serving as the image carrier, a charging section 12, an exposing section 13, a developing section 14, a transfer section 15, a toner collecting device and a deelectrifying lamp 17, all of which are arranged around the photosensitive drum 11. The photosensitive drum 11 rotates at a constant speed in a clockwise direction determined according to the paper conveying direction. The charging section 12 uniformly charges the surface of the photosensitive drum 11 rotating as described above, at a predetermined potential of −500 V, for example. The exposing section 13 scans the charged surface of the drum 11 with a laser beam in the main scanning direction which is parallel with the axis of the drum 11. The charged surface of the photosensitive drum 11 is selectively exposed to a laser beam, thereby forming an electrostatic latent image. The potential of an exposed position is set to −50 V, for example. The developing section 14 develops the electrostatic latent image on the photosensitive drum 11 into a visible toner image by feeding toner to be selectively adhered to the latent image as a developer. The transfer section 15 electrostatically charges the paper which passes through the transfer section in order to transfer the toner image onto the paper from the photosensitive drum 11 by electrostatic attraction. The toner collecting device 16 collects toner unnecessarily remaining on the photosensitive drum 11 after the transfer. The deelectrifying lamp 17 removes the charge unnecessarily remaining on the photosensitive drum 11 which has passed the toner collecting device 16. The fixing unit 9 fixes the toner image transferred at the transfer section 15, by means of heat and pressure.

Figure 2:
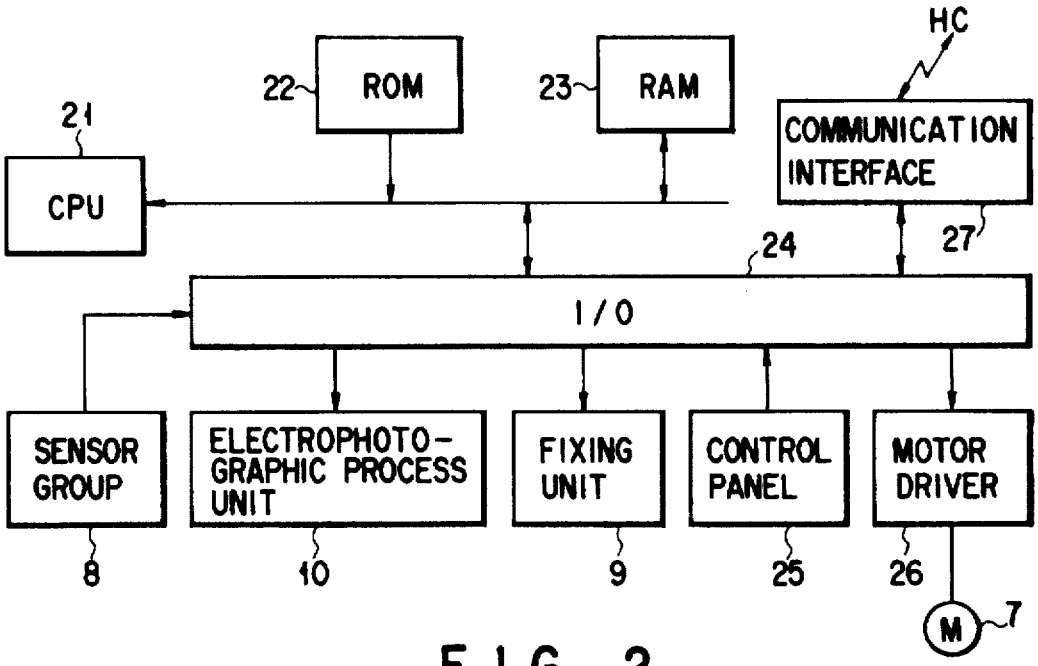
FIG. 2 is a block diagram showing a control circuit of th laser printer shown in FIG. 1.

FIG. 2 shows the control circuit 20 in detail. The control circuit 20 includes a CPU 21, a ROM 22, a RAM 23, an input and output circuit 24, a control panel 25, a motor driver 26 and a communication interface 27. The CPU 21 controls an overall sequence of the printing operation. The ROM 22 stores a control program for the CPU 21 and the other fixed data. The RAM 23 temporarily stores data such as dot image data or the like produced by the CPU 21. The input and output circuit 24 is provided to connect the electrophotographic process unit 10, the sensor group 8, the fixing unit 9, the control panel 25, the motor driver 26 and the communication interface 27 to the CPU 21. The control panel 25 inputs various instructions to the CPU 21 and displays the status of the printing operation. The motor driver 26 drives the motor 7. The communication interface 27 serves to receive print data or the like supplied from an external host computer HC.

In the printing operation of the laser printer having the above-described structure, the photosensitive drum 11 is processed in the order of the charging section 12, the exposing section 13, the developing section 14, the transfer section 15, the toner collecting device 16 and the deelectrifying lamp 17 as the drum 11 rotates. More specifically, the surface of the photosensitive drum 11 is uniformly charged by the charging section 12, and the charged surface is selectively exposed as it is scanned with a laser beam irradiated from the exposing section 13 according to the dot image data. After an electrostatic latent image is formed on the photosensitive drum 11 by this exposure, toner is fed to the surface of the drum 11 from the developing section 14. The toner is adhered onto the latent image by electrostatic attraction, thereby developing the latent image into a visible toner image. The transfer section 15 charges the paper supplied from the paper supply cassette 2, and the toner image is transferred from the surface of the drum 11 onto the paper by electrostatic attraction. After the transfer, the toner collecting device 16 removes toner remaining on the surface of the drum 11 despite the electrostatic attraction, and the deelectrifying lamp 17 removes the unnecessary charge from the surface of the drum 11. After the de-electrification, the photosensitive drum 11 recovers a chargeable state. The paper is conveyed from the transfer section 15 via the fixing unit 9 to the outside of the laser printer.

Figure 3:
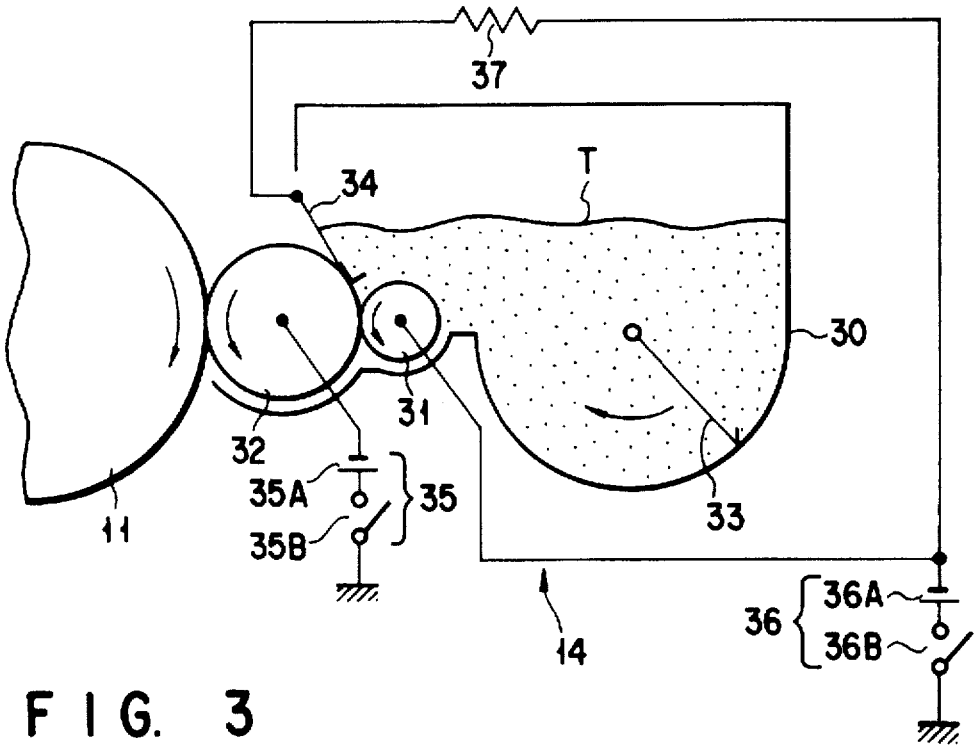
FIG. 3 is sectional view showing a developing section shown in FIG. 1 in detail.

FIG. 3 shows the developing section 14 in detail. The developing section 14 includes a hopper 30, a supply roller 31, a developing roller 32, an agitator 33, a conductive blade 34, a first high-voltage generator 35, and a second high-voltage generator 36. The hopper 30 is a container for storing toner. The supply roller 31 is arranged in the hopper 30 and made of, for example, conductive sponge. The developing roller 32 is arranged between the supply roller 31 and the photosensitive drum 11 in contact with these components, and made of, for example, conductive rubber. The agitator 33 agitates toner T stored in the hopper 30. The conductive blade 34 is made of a metal spring plate brought into contact with the developing roller 32 at a predetermined pressure. The first high-voltage generator 35 generates a development bias voltage of −200 V to be supplied to the developing roller 32. The second high-voltage generator 36 generates a supply bias voltage of −300 V to be supplied to the supply roller 31. The supply roller 31 and the developing roller 32 are set in parallel with the photosensitive drum 11, and coupled to receive the driving force from the motor 7 as well as the photosensitive drum 11. These rollers 31 and 32 rotate in the directions indicated by the arrows in FIG. 3. The peripheral speed of the developing roller 32 is set at a predetermined value close to that of the photosensitive drum 11. The first high-voltage generator 35 has a high-voltage source 35A and a switch 35B which are connected in series between the developing roller 32 and the ground terminal. A voltage of −200 V is generated from the high-voltage source 35A as the development bias voltage, and supplied to the developing roller 32 under the control of the switch 35B. The second high-voltage generator 36 has a high-voltage source 36A and a switch 36B which are connected in series between the supply roller 31 and the ground terminal. A voltage of −300 V is generated from the high-voltage source 36A as the supply bias voltage, and supplied to the supply roller 31 under the control of the switch 36B. The supply roller 31 biases the potential of toner T to −300 V with use of the supply bias voltage applied from the second high-voltage generator 36. The developing roller 32 biases the potential of toner T to −200 V with use of the development bias voltage applied from the first high-voltage generator 35. Further, the supply bias voltage is also used as the blade voltage of −300 V which is larger than the development bias voltage supplied to the developing roller 32 and is supplied from the second high-voltage generator 36 to the conductive blade 34 via a protection resistor 37. The toner T is electrostatically charged by the charge directly supplied from the conductive blade 34 contacting therewith in order to compensate for a shortage of the charge obtained by friction which occurs between the developing roller 32 and each of the conductive blade 34 and the supply roller 31. The protection resistor 37 has a resistance of about $10^3$ to $10^5$ ohms, and serves as a current limiting element for limiting a leak current which flows between the conductive blade 34 and the developing roller 32 due to a difference between the blade voltage and the development bias voltage.

In the above-described developing section 14, toner T moves closer to the supply roller 31 within the hopper 30 by its own weight or by means of the agitator 33. The potential of the toner T is biased by the supply bias voltage from the supply roller 31. The toner T is supplied from the supply roller 31 to the developing roller 32, and the potential thereof is biased by the development bias voltage from the developing roller 32. The conductive blade 34 uniformly limits the thickness of the toner T put on the developing roller 32. The developing roller 32 carries the toner T via the conductive blade 34 to the outside of the hopper 30. The toner T is electrostatically charged by friction thereof which occurs upon rotation of the developing roller 32 and by the blade voltage from the conductive blade 34, and adhered to the electrostatic latent image on the photosensitive drum 11 by electrostatic attraction.

Figure 4:
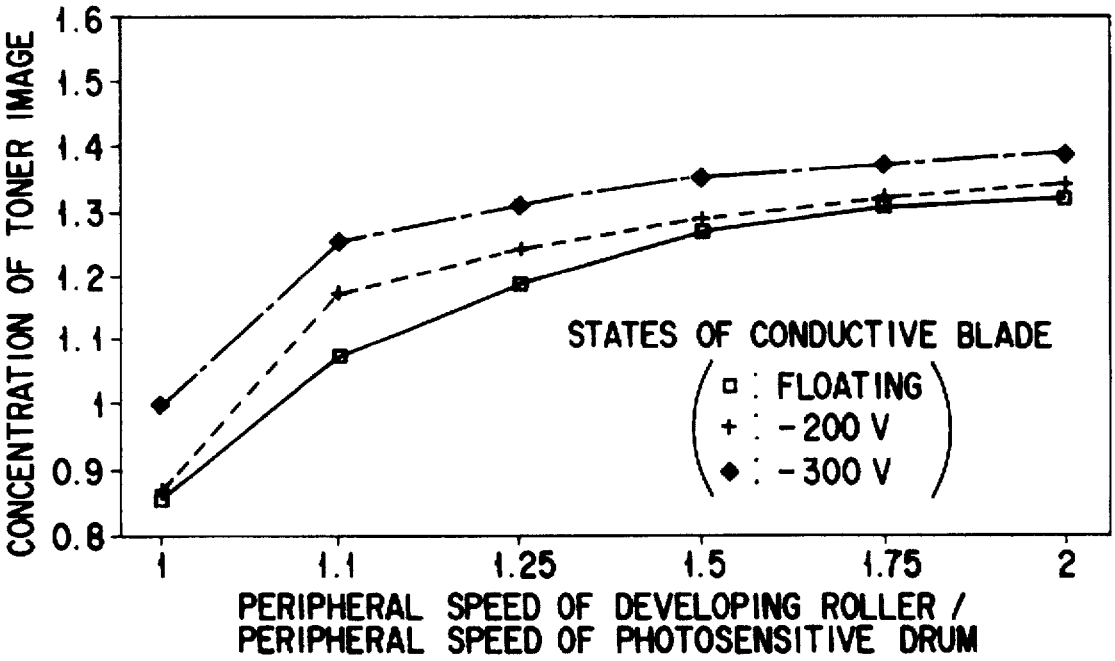
FIG. 4 is a graph illustrating a relationship between the ratio of the peripheral speed of the developing roller with respect to that of the photosensitive drum and the concentration of a toner image.
Figure 5:
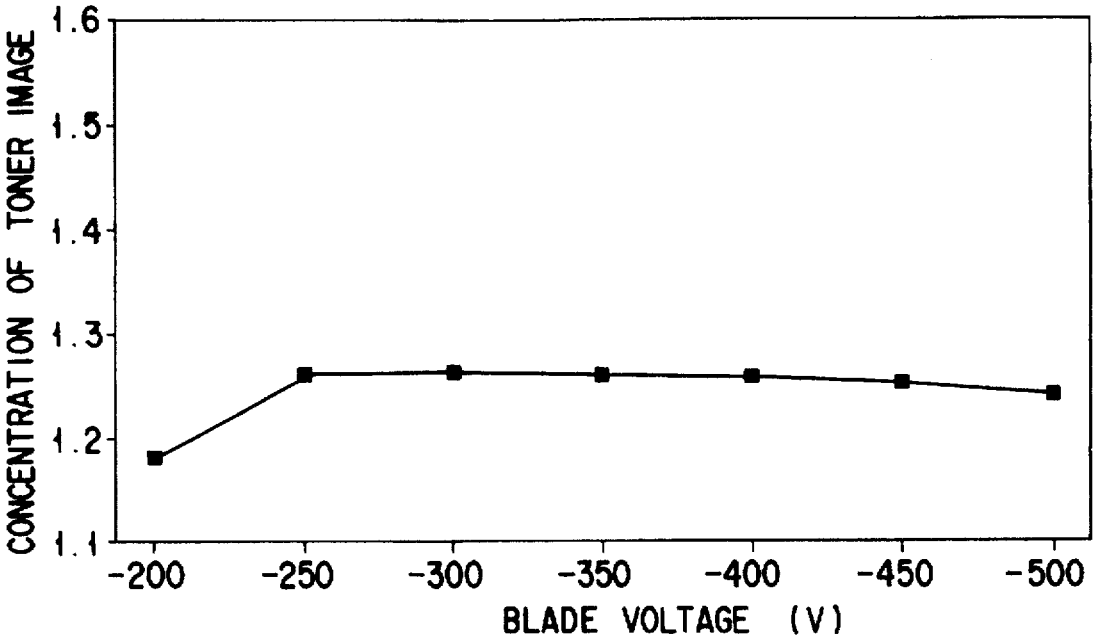
FIG. 5 is a graph illustrating a relationship between the voltage supplied to a conductive blade shown in FIG. 3 and the concentration of the toner image.

FIG. 4 shows the relationship between the ratio of the peripheral speed of the developing roller with respect to that of the photosensitive drum and the concentration of a toner image. (This concentration was measured using a Macbeth concentration scale.) A toner image is required to have an image concentration of at least about 1.25. In the case where the conductive blade 34 is in an electrically floating state as in a conventional manner or the conductive blade 34 is set equal to a development bias voltage (−200 V), the aforementioned concentration can be obtained by setting the peripheral speed of the developing roller 32 about 1.5 times that of the photosensitive drum 11, as can be seen in FIG. 5. However, in the case where the conductive blade 34 is set equal to the supply bias voltage (−300 V), the peripheral speed of the developing roller 32 can be reduced to about 1.1 times of that of the photosensitive drum 11.

FIG. 5 shows the relationship between the voltage supplied to the conductive blade 34 and the concentration of the toner image. (This concentration was measured using a Macbeth concentration scale.) The ratio of the peripheral speed of the developing roller 32 to that of the photosensitive drum is 1.1 in the case shown in FIG. 5. As can be seen in FIG. 5, the toner image concentration is substantially saturated when the blade voltage is −250 V or higher in absolute value, whereas the toner image concentration is set lower than the saturation level when the blade voltage is less than −250 V.

In the above-described embodiment, the conductive blade 34 is used for creating friction of the toner T on the developing roller 32 and supplying a charge to the toner T in order to electrostatically charge the toner T. In the case where the peripheral speed of the developing roller 32 is set closer to that of the photosensitive drum 11, this decreases the frictional force of the toner T while solving the problems regarding the wear of the photosensitive drum 11, the toner film that is difficult to removed from the developing roller 32, the torque and noise of the developing roller 32. However, the second high-voltage generator 36 supplies a blade voltage (=−300 V) higher in absolute value than a developer bias voltage (=−200 V) to the conductive blade 34 so as to electrostatically charge the toner T. Therefore, the toner T can have a sufficient amount of charge with which an electrostatic latent image is developed into a toner image of an excellent concentration. In the actual development, it is confirmed that the thickness of the toner image is satisfactorily increased.

Further, according to the embodiment, the protection resistor 37 is provided to limit the leak current which flows between the conductive blade 34 and the developing roller 32 due to the difference between the blade voltage and the developer bias voltage. This limitation of a leak current effectively prevents the deterioration of the quality of the toner image and the malfunction of the apparatus from occurring due to a noise caused by the leak current. The resistance of the protection resistor 37 is set at about $10^3$ to $10^5$ ohms in order to limit the leak current without adversely affecting the charging of the toner T. For this reason, the peripheral speed of the developing roller 32 can be set closer to that of the photosensitive drum 11 without deteriorating the development properties.

In case where no protection resistor 37 is provided, the blade voltage needs to be set to, for example, −250 V (lower in absolute value than the supply bias voltage of −300 V) in order to reduce the potential difference between the developing roller 32 and the conductive blade 34. With such a structure, the leak current can be reduced; however, a high-voltage generator should be provided independently from the high-voltage generators 35 and 36 in order to generate a blade voltage which differs from the development bias voltage or supply bias voltage. In this embodiment, the protection resistor 37 limits the leak current, and surely prevents the toner image from being influenced due to the leak current. Therefore, the blade voltage is selected to be equal to the supply bias voltage (=−300 V), and the second high-voltage generator 36 is commonly used for obtaining both the supply bias voltage and the blade voltage. This structure makes it possible to manufacture the developing section 14 smaller in size and lower in cost than the case where an independent high-voltage generator is provided to obtain the blade voltage.

Figure 6:
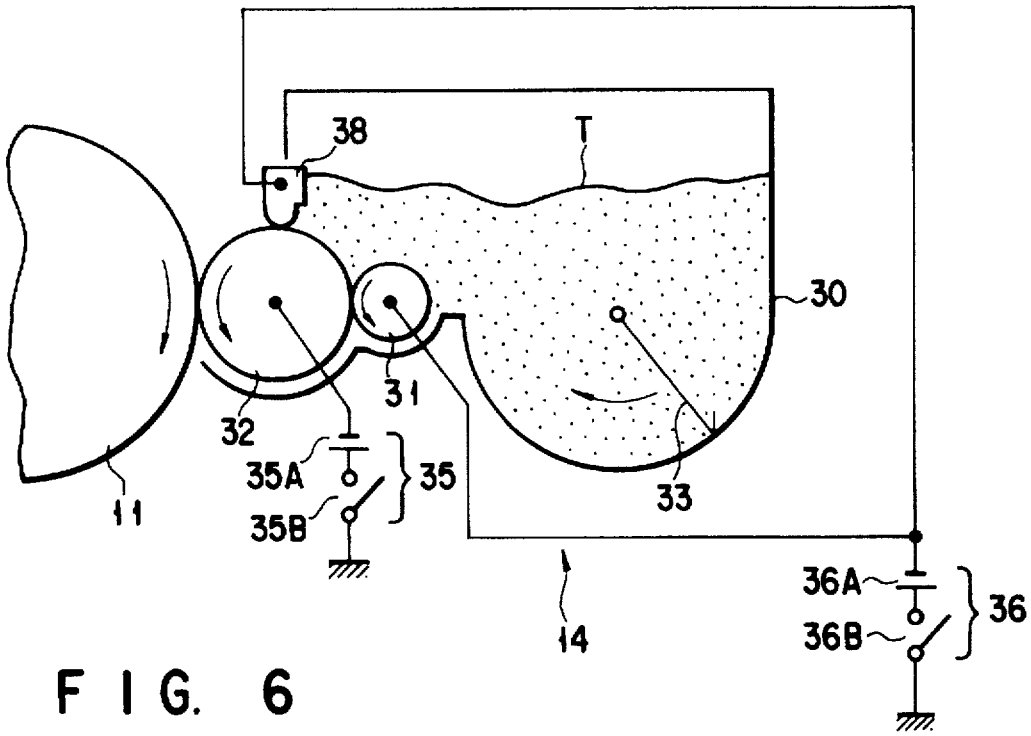
FIG. 6 is a sectional view showing a modification of the developing section shown in FIG. 3.

FIG. 6 shows a modification of the developing section 14 shown in FIG. 3. This modification differs from the developing section 14 in that a blade 38 made of conductive rubber is provided in place of the metal blade 34 and the protection resistor 37. An example of the conductive rubber is silicon rubber. This blade 38 is brought into contact with the developing roller 32 at a predetermined pressure so as to uniformly limiting the thickness of the toner T put on the developing roller 32 and electrostatically charge the toner T by means of the blade voltage. Further, the blade 38 has a resistance of about $10^3$ to $10^5$ ohms, as in the case of the protection resistor 37 shown in FIG. 3. This resistance limits a leak current which flows between the blade 38 and the developing roller 32, without adversely affecting the charging of the toner T performed by means of a current which flows through the blade 38.

According the structure of this modification, the protection resistor 37 is not required to obtain the aforementioned effects. This makes it possible to reduce the number of components constituting the developing section 14.

In the embodiment described above, an electrostatic latent image is formed on the photosensitive drum 11. However, the photosensitive drum 11 can be replaced by an image carrier such as a dielectric belt. In this case, the developing section 14 develops an electrostatic latent image formed on the dielectric belt.

Further, the second high-voltage generator 36 is used to obtain both the supply bias voltage and the blade voltage. However, in case where, for example, the blade voltage and the supply bias voltage are not set equal to each other, a high-voltage generator may be independently provided in order to obtain the blade voltage.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A developing apparatus comprising:

a developing roller, disposed in contact with an image carrier on which an electrostatic latent image is formed, for rotating with said image carrier to provide a developer for adherence to the electrostatic latent image formed on said image carrier;

a supply roller for supplying the developer to said developing roller;

a conductive blade for uniformly limiting a thickness of the developer on said developing roller;

first high-voltage generating means for generating a development bias voltage which is provided to said developing roller for biasing a voltage potential of the developer;

second high-voltage generating means for generating a blade voltage having a larger absolute value than said development bias voltage, said blade voltage being supplied to said conductive blade for electrostatically charging the developer to compensate for a shortage of an electrostatic charge obtained in the developer by friction on said developing roller; and current limiting means for limiting a leak current which flows between said conductive blade and said developing roller;

wherein said second high-voltage generating means is operatively coupled to supply the blade voltage to said supply roller as a supply bias voltage for biasing a potential of the developer.

2. The developing apparatus according to claim 1, wherein said current limiting means is made of a resistive element inserted between said second high-voltage generating means and said conductive blade.

3. The developing apparatus according to claim 1, wherein said conductive blade is made of a conductive rubber, and said current limiting means is made of a resistance of said conductive rubber.

4. The developing apparatus according to claim 1, wherein said current limiting means has a resistance of $10^3$ to $10^5$ ohms to limit the leak current without adversely affecting the charging of the developer.

5. The developing apparatus according to claim 1, wherein a rotational direction of said developing roller is opposite to that of the image carrier.

6. The developing apparatus according to claim 5, wherein a peripheral speed of said developing roller is substantially identical to that of said image carrier.

* * * * *